United States Patent [19]

Gilbert

[11] 4,342,157

[45] Aug. 3, 1982

[54] SHOCK ABSORBING PARTIALLY LIQUID-FILLED CUSHION FOR SHOES

[76] Inventor: Sam Gilbert, 17965 Seabreeze, Pacific Palisades, Calif. 90272

[21] Appl. No.: 177,076

[22] Filed: Aug. 11, 1980

[51] Int. Cl.[3] ..... A43B 13/20; A43B 21/26

[52] U.S. Cl. ..... 36/29; 36/35 B; 128/594

[58] Field of Search ..... 36/28, 29, 3 B, 43, 36/44, 35 B; 128/594, 595

[56] References Cited

U.S. PATENT DOCUMENTS

| | | | |
|---|---|---|---|
| 1,109,180 | 9/1914 | Rosenberg | 36/35 B |
| 2,605,560 | 8/1952 | Gouabault | 36/29 |
| 3,044,190 | 7/1962 | Urbany | 36/29 |
| 3,120,712 | 2/1964 | Menken | 36/29 |
| 4,017,931 | 4/1977 | Golden | 36/44 X |
| 4,100,686 | 7/1978 | Sgarlato et al. | 36/29 |

FOREIGN PATENT DOCUMENTS

| | | | |
|---|---|---|---|
| 352216 | 4/1922 | Fed. Rep. of Germany | 36/29 |
| 692881 | 6/1940 | Fed. Rep. of Germany | 36/29 |
| 721492 | 12/1931 | France | 36/29 |

*Primary Examiner*—James Kee Chi

*Attorney, Agent, or Firm*—Robert Louis Finkel

[57] ABSTRACT

A thin-walled hollow partially liquid-filled cushion is permanently enclosed in a cavity formed in the sole of a shoe. Preferably, the cushion is produced by vacuum-forming a pan, having a continuous circumferential lip, from a sheet of durable, flexible, resilient, non-porous thermoplastic material, heat sealing a sheet of similar material to all but a small region of the lip, partially filling the pan with a low-viscosity liquid by means of a fine tube inserted between the unsealed lip and sheet, and sealing the sheet to the previously unsealed region of the lip. A critical feature of the invention resides in the formation of the cavity in the shoe sole to contain the cushion with the cushion walls, top and bottom in intimate contact with, and the contents of the cushion under pressure exerted by, the walls, top and bottom of the cavity.

16 Claims, 3 Drawing Figures

SHOCK ABSORBING PARTIALLY LIQUID-FILLED CUSHION FOR SHOES

BACKGROUND OF THE INVENTION

1. Field of the Invention

This invention relates to shock absorbing devices for shoes, and more particularly to liquid-filled shoe cushions. Specifically, it concerns a novel construction for, and method for producing, a partially liquid-filled cushion which is adapted to be permanently enclosed in a cavity formed in the sole of a shoe.

2. Prior Art

Pads of resilient material and liquid- and air-filled cushions, adapted to be inserted into shoes, are well known. Generally, these are intended for comfort and have limited shock absorbing ability. While they may be adequate for easing the foot strain and fatigue caused by standing or walking on hard surfaces for long periods, they offer little if any protection against repeated foot impact, such as that encountered by the active athlete in running and jumping.

Additionally, since slip-in pads and cushions tend to move about within the shoe, they are at best ineffectual, and are frequently actually hazardous to the wearer, when subjected to the severe stresses generated by the abrupt twisting, turning, starting and stopping common to most sports. The same movement tends quickly to deform and create worn spots in most such pads and cushions, thus rendering them uncomfortable and short-lived as well.

Merely increasing the thickness or stiffness of slip-in devices or of the inner soles of the shoes themselves eliminates few of these problems, and in fact creates others which make this approach to protecting the active wearer's foot from high impact forces unacceptable. In the case of the prior art attempts to provide a successful "heavy duty" shock-absorbing liquid-filled slip-in cushion, one particularly vexing difficulty which is repeatedly encountered arises from the inherent inability of the unsupported structure to withstand the enormous forces generated by the movements of athletes, such as basketball players, which cause the distended bladder literally to explode.

Various attempts have been made to construct a shoe having a sole containing a built-in pad or liquid-filled cushion. These, too, have been unsatisfactory. Padding alone does not provide adequate resilience, and efforts to construct a sole incorporating fluid-filled cavities have failed to overcome the problems of deterioration, delamination and fluid leakage.

The principal object of the subject invention is to overcome all of these deficiencies and to provide a light weight comfortable shoe which cushions the wearer's foot against the extremely high impact forces encountered in the more rigorous physical activities.

Another object is the provision of such a shoe which localizes the shock absorption at the most vulnerable areas of the wearer's foot.

Still another object is the provision of means for incorporating a shock-absorbing cushion in the shoe construction, thus preventing displacement and permanent deformation of the cushion.

Yet another object is the provision of a construction which integrates such a cushion with the shoe sole, thereby distributing the impact forces throughout the sole, rather than retaining them within the cushion.

Yet another object is the integration of such a cushion in the construction of the shoe so as to provide resistence to front, rear and side loading as well as vertical impact.

Another object is to provide a partially fluid-filled shock-absorbing cushion which may readily be mass produced.

A further object is to provide a construction of a shoe sole which permits speciality shoes to be made up with precisely the firmness and shock absorbency desired by the individual wearer.

BRIEF DESCRIPTION OF THE INVENTION

The subject invention includes a high impact-resistent cushion for shoes, a method for manufacturing such a cushion, the combination of a shoe with such a cushion, and a method for manufacturing such a shoe.

Essentially the cushion is a thin-walled hollow partially liquid-filled bladder adapted to be fully enclosed in a cavity formed in the sole of a shoe, such as those worn by athletes, construction workers or others involved in strenuous athletics or physical activity. The cushion is produced in two sections, a pan having upstanding walls terminating in a continuous circumferential lip, vacuum- or blow-formed from a sheet of durable, flexible, resilient, non-porous thermoplastic material, and a cover sheet of similar material. The cover sheet is heat sealed to the lip, except in a small region of the lip, which is left unsealed to permit the insertion of a fine filling tube. The tube is used to introduce a predetermined volume of a suitable liquid into the pan and is then withdrawn and the heat sealing of the cover sheet and lip completed. If desired, air under pressure may be supplied through the filling tube just prior to its withdrawal and the cushion sealed in a slightly inflated condition.

As a unique feature of the construction of the shoe sole, the cavity in the sole is sized to receive the partially filled cushion with its thin walls and bottom in intimate contact with the walls and bottom of the cavity, and with its top extending slightly above the upper edge of the cavity. When the sole is completed by the addition of a top layer, the cushion is compressed so that the air trapped in it exerts a continuous pressure against the walls, top and bottom of the cavity.

The details of the subject invention will be more fully appreciated upon consideration of the following description of several of its preferred embodiments, taken in connection with the appended drawings.

THE DRAWINGS

In the drawings.

Where practicable, the same numeral is used in the several figures to represent the same or substantially similar features.

DETAILED DESCRIPTION OF THE PREFERRED EMBODIMENTS

Figure 1:
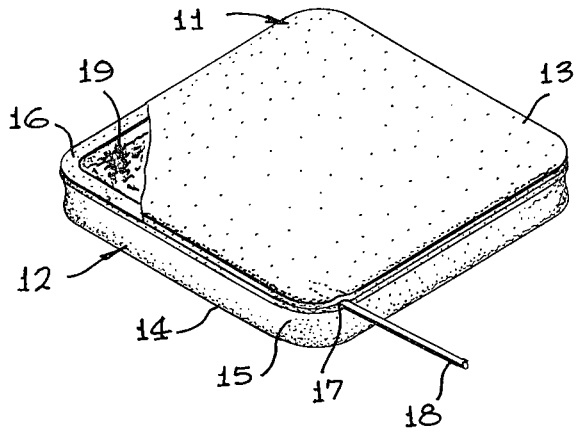
FIG. 1 is a top perspective view illustrating a typical cushion embodying the subject invention as it appears during the filling stage of manufacture, with a portion of the cover sheet cut away for illustrative purposes.

Referring to FIG. 1., a cushion 11 in accordance with the subject invention may be produced from suitable materials using any of the well known techniques for forming liquid-filled thin-walled bladders. Preferably, however, it is fabricated by assembling and joining two parts, a pan 12, and a cover 13.

Pan 12 may take various forms, but preferably it has a generally rectangular bottom 14 and upstanding walls 15 terminating in a continuous outwardly projecting lip 16. Pan 12 is adapted to be mass-produced by vacuum-forming, blow-forming, or other conventional means from polyurethane, polyvinyl chloride or other suitable flexible, resilient, non-porous thermoplastic sheet or film. The top or cover 13 is of the same or similar material and may be cut to size from a larger sheet before or after the final sealing stage. In either case, the outer edges of cover 13 are heat sealed to the lip 16 of pan 12 by conventional means, except in a narrow region 17 where a small opening is provided between cover 13 and lip 16 for the insertion of a fine filling tube 18.

Tube 18 is connected to a source (not shown) of water, mineral oil, glycerine or other suitable low-viscosity liquid from which a predetermined volume of liquid is dispensed from tube 18 into pan 12. In practice, the volume of fluid is from about 75 percent to about 95 percent of the volume of pan 12, the precise amount depending upon the type of shoe, the activity for which it is to be used, the degree of resiliency and flexibility desired, and in the case of custom-made shoes, the particular personal "feel" preferred by the intended wearer. When the pan has been filled with the predetermined volume of fluid, tube 18 is removed and cover 13 sealed to lip 16 in region 17. Preferably, a low-pressure stream of air is introduced into pan 12 through tube 18 while the tube is being withdrawn and cover 13 sealed to lip 16, in order to leave cushion 11 slightly inflated. This is not necessary, but as will be seen, inflating cushion 11 serves to enhance a highly desirably intimate fit between the walls, top and bottom of cushion 11 and the cavity in the shoe sole into which it will be inserted.

Figure 2:
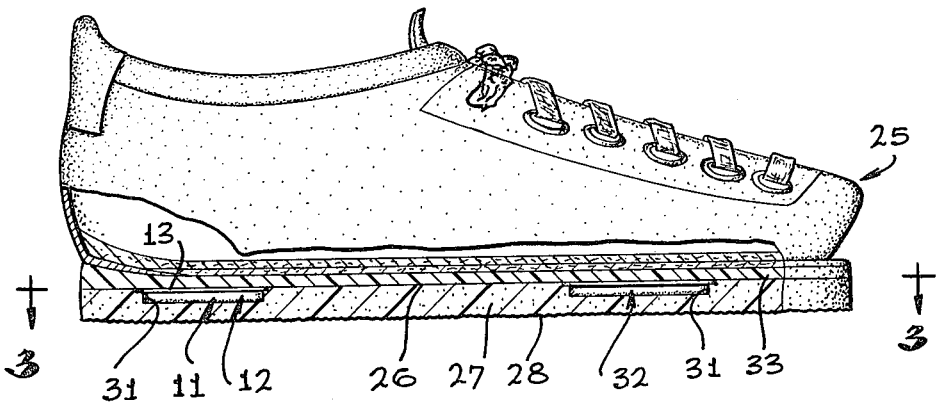
FIG. 2 is a side view of a typical athletic shoe incorporating cushions similar to that shown in FIG. 1, with portions of the shoe cut away for illustrative purposes.
Figure 3:
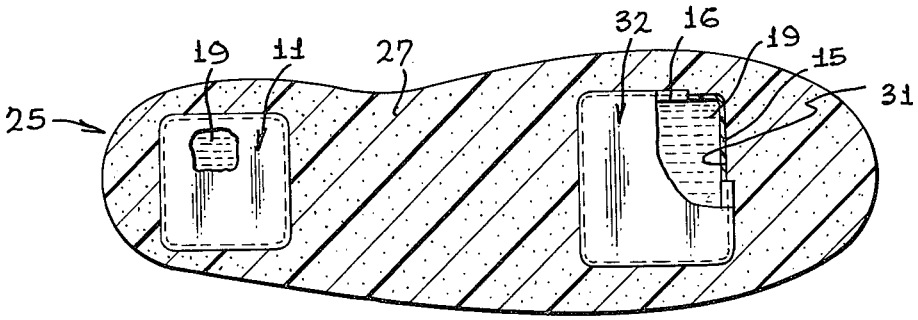
FIG. 3 is a top sectional view of the shoe of FIG. 2, taken in the direction 3—3, with portions cut away for illustrative purposes.

FIGS. 2 and 3 illustrate the construction and method of assembling a shoe 25, such as a typical running shoe embodying the invention. As is customary, the sole 26 of shoe 25 is constructed in multiple layers, generally with a bottom layer 27 of durable rubber or composition into the underside of which a tread pattern 28 is impressed to give added traction. In the embodiment illustrated, a pair of open recesses or cavities 31 are formed in the upper surface of layer 27. Cavities 31 conform closely to the outer dimensions of the bottom 14 and walls 15 of cushions 11 and 32, the latter being constructed in exactly the same form as previously described, but preferably being somewhat larger in length and width than the former.

In assembling sole 26, cushions 11 and 32 are inserted into cavities 31. Preferably, the depth of cavities 31 is slightly less than the height of cushions 11, 32, so the covers 13 are slightly higher than the surrounding upper surface of layer 27. Layer 33 is laid over layer 27 and cemented to it under pressure, which insures a tight bond between the two layers. With layer 33 firmly in place, the air in cushions 11, 32 is compressed and the pressure exerted by it maintains walls 15, covers 13, and bottoms 14 in tight contact with the adjacent walls, tops and bottoms of cavities 31.

In all other respects the construction and appearance of shoe 25 are conventional. Being made of extremely light weight materials, cushions 11, 32 add little if any additional weight, and their presence has no noticeable effect on the shoe's function.

Preferably, cushions 11, 32 are positioned under the heel and ball of the wearer's foot, but if desired, their size and location may be altered for maximum effectiveness.

It will be understood that the exact details of construction shown and described were selected for illustrative purposes, and obvious modifications can be made by a person skilled in the art without departing from the spirit or scope of the invention as it is defined in the following claims.

I claim:

1. An impact-absorbing cushion adapted for containment within a cavity in a shoe sole, said cavity having sides, a top and a bottom, comprising:

a sealed bladder comprising a thin, flexible, resilient, non-porous shell, having walls, a top and a bottom closely conforming to the walls, roof and floor of said cavity, said bladder containing a liquid under pressure, whereby the walls, top and bottom of said shell are maintained in continuous intimate force-transmitting contact with the walls, roof and floor of said cavity.

2. The cushion of claim 1, wherein said liquid comprises from about 75 percent to about 95 percent of the volume of said bladder.

3. The cushion of claim 2, wherein said liquid is of low viscosity and said bladder contains, additionally, gas under pressure.

4. The cushion of claim 3, wherein the pressure within the shell is sufficient to distend the walls, top and bottom of said bladder and thereby deform the walls, roof and floor of said cavity.

5. The cushion of claim 1, wherein said bladder comprises:

a pan having a bottom and upstanding walls, said walls terminating in a continuous, laterally projecting lip; and a generally planar top sealingly secured at its periphery to said lip.

6. The cushion of claim 5, wherein:

said liquid comprises from about 75 percent to about 95 percent of the volume of said bladder; and said bladder contains, additionally, gas under pressure.

7. The cushion of claim 6, wherein the pressure within the shell is sufficient to distend the walls, top and bottom of said bladder and thereby deform the walls, roof and floor of said cavity.

8. A method for making a partially liquid-filled high-impact-absorbing cushion for containment within a cavity in a shoe sole, comprising:

forming from a sheet of thin, flexible, resilient, non-porous thermoplastic material a pan having a bottom and upstanding walls terminating in a continuous laterally projecting lip;

heat sealing a generally planar top sheet of similar material to said lip, except in a narrow region thereof, to produce a bladder having an opening therein;

inserting a fine filling tube into said bladder between said lip and top sheet in said narrow region;

introducing a predetermined volume of liquid into said bladder through said filling tube;

withdrawing said filling tube while forcing gas through said tube under sufficient pressure to distend the walls, bottom and top of said bladder; and completing the heat sealing of said top sheet to said lip in said region, thereby entrapping gas under pressure within said bladder.

9. The method of claim 8, wherein the volume of said liquid comprises from about 75 percent to about 95 percent of the volume of said bladder.

10. A shoe, comprising:

a sole including at least one cavity having walls, a roof and a floor; and a sealed bladder confined within said cavity comprising a thin, flexible, resilient non-porous shell having walls, a top and a bottom closely conforming to the walls, roof and floor of said cavity, said bladder containing a liquid under pressure, whereby the walls, top and bottom of said shell are maintained in continuous intimate force-transmitting contact with the walls, roof and floor of said cavity.

11. The shoe of claim 10, wherein said liquid is of low viscosity and said bladder contains, additionally, gas under pressure.

12. The shoe of claim 11, wherein said bladder comprises:

a pan having a bottom and upstanding walls, said walls terminating in a continuous, laterally projecting lip; and a generally planar top sealingly secured at its periphery to said lip.

13. The shoe of claim 12, wherein said liquid comprises from about 75 percent to about 95 percent of the volume of said bladder.

14. A method for making a high-impact absorbing multi-layer sole for shoes, comprising:

forming a recess in the surface of a first one of said layers;

inserting into said recess a sealed bladder having a thin, flexible, resilient, non-porous shell containing a liquid and a gas under pressure, whereby said shell is distended to a volume somewhat greater than the volume of said recess; and laminating a second one of said layers to the surface of said first layer, covering said recess and in intimate contact with said bladder, thereby forming a cavity enclosing the bladder, compressing the bladder and maintaining the shell of said bladder in continuous intimate force-transmitting contact with the walls, top and bottom of said cavity.

15. The method of claim 14, wherein the volume of said liquid comprises from about 75 percent to about 95 percent of the volume of said bladder.

16. The method of claim 15, wherein:

said bladder comprises a bottom, a plurality of upstanding walls terminating in a laterally projecting lip, and a top sealingly secured at its periphery to said lip; and said lip and the periphery of said top extend laterally outwardly of said cavity between said first and second layers.

* * * * *